US009205022B2

(12) United States Patent
Huang et al.

(10) Patent No.: US 9,205,022 B2
(45) Date of Patent: Dec. 8, 2015

(54) MULTIFUNCTIONAL SPA DEVICE

(71) Applicants: Cheng-Hsiang Huang, Miaoli County (TW); Kuang-Chao Huang, Miaoli County (TW)

(72) Inventors: Cheng-Hsiang Huang, Miaoli County (TW); Kuang-Chao Huang, Miaoli County (TW)

(73) Assignee: Cheng-Hsiang Huang, Miaoli County (TW)

( * ) Notice: Subject to any disclaimer, the term of this patent is extended or adjusted under 35 U.S.C. 154(b) by 0 days.

(21) Appl. No.: 13/737,109

(22) Filed: Jan. 9, 2013

(65) Prior Publication Data

US 2013/0185864 A1 Jul. 25, 2013

Related U.S. Application Data

(63) Continuation-in-part of application No. 12/551,629, filed on Sep. 1, 2009, now abandoned.

(51) Int. Cl.
*A61H 33/00* (2006.01)
*A61H 33/02* (2006.01)

(52) U.S. Cl.
CPC ..... *A61H 33/0087* (2013.01); *A61H 33/02* (2013.01); *A61H 33/6036* (2013.01)

(58) Field of Classification Search
USPC ..... 4/559; 601/154–160; 417/151
See application file for complete search history.

(56) References Cited

U.S. PATENT DOCUMENTS

| | | | | |
|---|---|---|---|---|
| 2,210,846 | A * | 8/1940 | Aghnides | 239/428.5 |
| 3,304,936 | A * | 2/1967 | Kosta | 601/157 |
| 3,835,846 | A * | 9/1974 | Kurtz | 601/167 |
| 5,038,420 | A * | 8/1991 | Chen | 4/538 |
| 5,404,598 | A * | 4/1995 | Hadsell | 4/541.4 |

* cited by examiner

*Primary Examiner* — Lauren Crane
(74) *Attorney, Agent, or Firm* — Rosenberg, Klein & Lee

(57) ABSTRACT

The invention relates to a multifunctional spa device. It is mainly that an inlet of a pump controlled by a circuit is additionally connected to a vent pipe, an outlet of the pump is connected to a jet, and the pump sucks a water flow through an intake pipe while air is simultaneously sucked through the vent pipe to be mixed with the water flow in the pump. An outlet disk is configured in the jet, and pores are distributed on an outer circumference of the outlet disk. With the jet inside-out to transmit the air-mixing water flow, the air-mixing water flow is further compressed and released through the pores, thus to output water flows or the water columns carried with ultramicro bubbles.

5 Claims, 12 Drawing Sheets

MULTIFUNCTIONAL SPA DEVICE

This application is being filed as a continuation-in-part application of U.S. patent application Ser. No. 12/551,629, entitled "Multifunctional spa device", currently pending.

BACKGROUND OF THE INVENTION

1. Field of the Invention

The invention relates to a multifunctional spa device. In the invention, it is mainly that an inlet of a pump controlled by a circuit is additionally connected to a vent pipe to mix a gas into water, so that the functions of outputting ultramicro bubbles or water columns can be obtained.

2. Description of the Related Art

Spa means massage through moving water. In general, a set of spa facility may include a massage bathtub, a water column jet with different pressures and an anion emulsion fountain, etc. The spa facility often includes many structural costs for large-sized structural components, and these structural components shall be pre-installed by complete sets. That is, the spa facility cannot be directly installed on a general or existed bathtub. Therefore, market competiveness of the set of spa facility cannot be effectively increased.

In conventional massage bathtubs, a pump is utilized to supply power, and water in the bathtub is circulatingly sucked and pushed to provide a high speed or high pressure water flow, thus to obtain spa massage function. However, the waste water is still remained in the pump when the conventional massage bathtub is not in use, and the waste water remained in the pump or circulation pipes only can be allowed to enter the bathtub through nozzles, resulting in the waste water (e.g., waste water remained in the water-uptake opening and a length of pipeline between the inlet of the pump and the pump) unable to be completely expelled. On these grounds, in most instances, most of users actually do not know whether water in the conventional massage bathtub is clean or not.

Furthermore, in conventional spa facilities, components such as the massage bathtub and the water column jet with different pressures and functions such as anion emulsion fountain are individually completed by different single-function structures, and thus a certain area for installing the spa facility and a large expenditure are required. On these particular grounds, it is inconvenient and unacceptable for most of users to have one spa facility in their houses.

BRIEF SUMMARY OF THE INVENTION

In view of this, the invention provides a multifunctional spa device for solving difficulties in conventional skills.

To achieve the above-mentioned purpose, in the multifunctional spa device of the invention, it is mainly that an inlet of a pump controlled by a circuit is additionally connected to a vent pipe, an outlet of the pump is connected to a jet, the pump sucks a water flow through an intake pipe while air is simultaneously sucked through the vent pipe to be mixed with the water flow in the pump. Pores are distributed ahead of an outlet of the jet. With the jet inside-out to transmit the air-mixing water flow, the air-mixing water flow is recompressed and released through the pores, thereby outputting water flows or the water columns carried with ultramicro bubbles.

In the multifunctional spa device of the invention, the vent pipe is configured with a switch, in which the switch is utilized to open and close the vent pipe.

In the multifunctional spa device of the invention, the vent pipe is configured with a flow limiting device, in which the flow limiting device is pre-regulated at a position where enables the air flow and the pressure change of the pump to have a maximum mixed effect.

In the multifunctional spa device of the invention, a thin-plate type outlet disk is configured in the jet, and pores are distributed on an outer circumference region of the outlet disk.

In the multifunctional spa device of the invention, a pipe is outwardly and connectively configured ahead of an outlet of the jet.

In the multifunctional spa device of the invention, a normally closed type solenoid valve disposed between the vent pipe and the pump is connected to a main switch.

The multifunctional spa device of the invention providing effects as follow.

In the multifunctional spa device of the invention, the pump has an outlet pipe designed with the jet. When the pump sucks water of the bathtub through the intake pipe, an initial ejected water flow from the jet is sprayed outside the bathtub, thereby completely removing the waste water from the circulation pipes and assuring cleanness of water in the bathtub. Further, after the jet is put in water of the bathtub, the water flows or the water columns output from the jet are mixed with large amount of air due to the pump sucking air through the vent pipe (a vacuum attraction force can be generated to act on air of the vent pipe when water in the intake pipe is continuously transmitted by the pump). When the air-mixing water flows are compressed and releasingly ejected through the pores ahead of the outlet of the jet, a large amount of micro bubbles can be formed in water, thereby providing ultramicro bubble water for massaging in the bathtub.

Moreover, the pressure of the water flow or the water column can be changed (air is compressible; the more air inflow is taken, the less water pressure is output) by using the switch (or the flow limiting device) to control air inflow of the vent pipe, and the jet is allowed to generate water flows or water columns with different pressures, so that a user can hold the jet to directly spray water to the body thereof. More particularly, with the jet situated in an oxygen-enriched state to be put in water of the bathtub, the jet can provide water with a high frequency resonance effect, thereby enabling water in the bathtub to have an anion emulsion fountain effect. With respect to the anion emulsion fountain effect, water in the bathtub can be processed to instantaneously produce numerous micro bubbles, thus to form a creamy-white water. Then, with the micro bubbles of the creamy-white water, micro explosion actions can be produced at regions where are closely approached to skin surface and deep layers of capillary holes, thereby performing a deeply cleaning to all skins and capillary holes of the body. Besides, the fully oxygen-enriched micro bubbles are capable of increasing oxygen content of human skin, facilitating cell activation, removing toxins in the body and speeding up blood circulation.

The invention further comprises a pipe which is configured at an outlet of the jet to change ejection type of the water flow or the water column, thus to provide multiple variation of water flow strength and ejected water line. Accordingly, the invention can provide a multifunctional operation performance in a single machine, and the small-sized structure of the invention is very suitable for use in a family bathtub.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
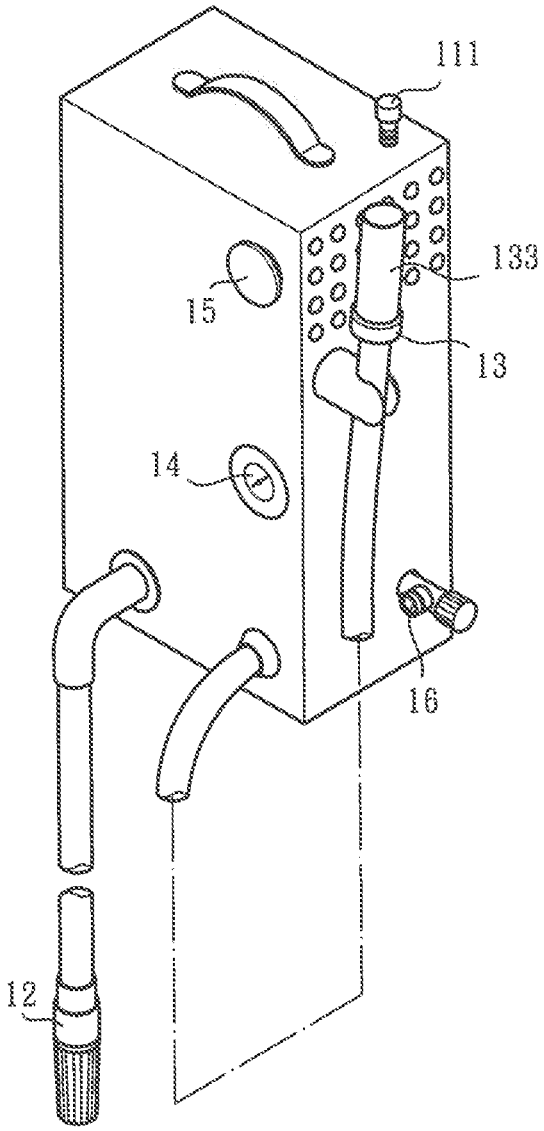
FIG. 1 is an outward appearance view of a structural composition of the invention.
Figure 2:
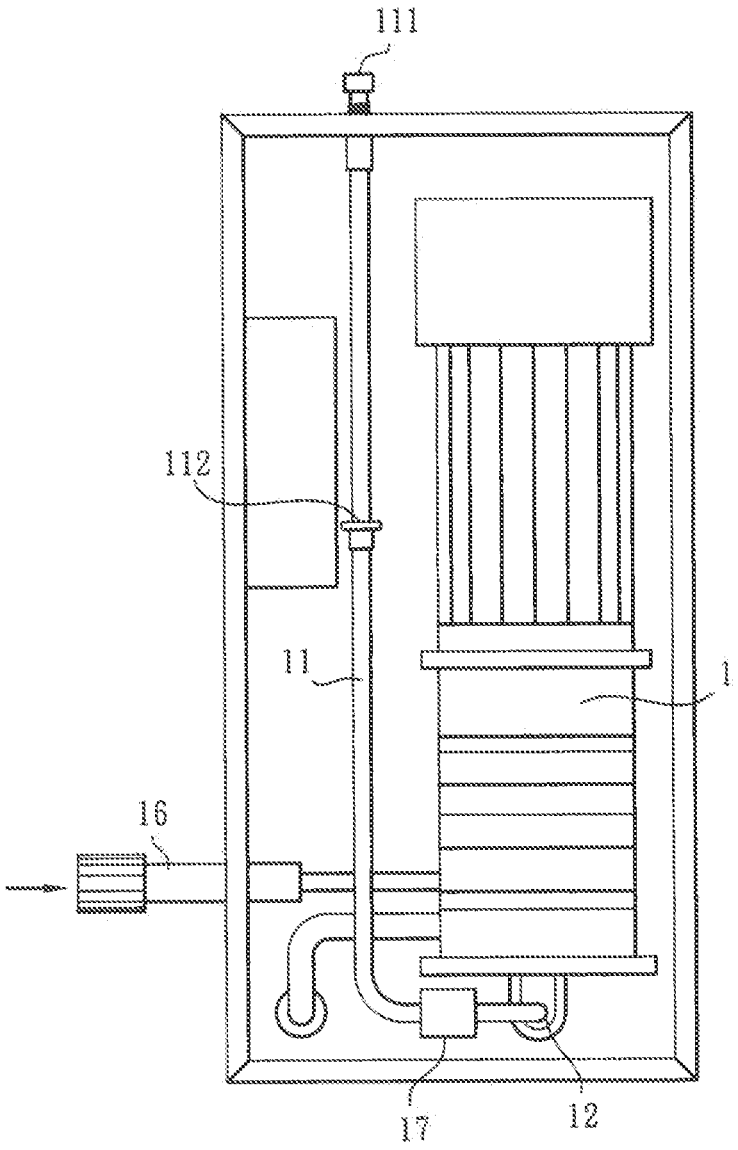
FIG. 2 is a reference view of an inner structure of the invention.

As shown in FIGS. 1 and 2, the invention relates to a multifunctional spa device, in which an inlet of a pump 1 controlled by a circuit is additionally connected to a vent pipe 11, a normally closed type solenoid valve 17 disposed between the vent pipe 11 and the pump 1 is linked or connected to a main switch 15, an outlet of the pump 1 is connected to a jet 13 provided with a turbulent action, and a plurality of pores 132 are configured on a water passage ahead of an outlet of the jet 13. When the pump 1 sucks a water flow through an intake pipe 12, air is simultaneously sucked through the vent pipe 11 to be mixed with the water flow in the pump 1; meanwhile, with the turbulent action of the jet 13 and functions of recompression, release and ejection of the pores 132, the water flow passes through the pores 132 to pump out an ejected water flow or an ejected water column which contains a large amount of micro bubbles.

According to the above-mentioned structural composition of the invention, it is understood that the vent pipe 11 is configured with a switch 111 and a flow limiting device 112. In this embodiment, the flow limiting device 112 can be replaced by an air inlet valve which is capable of maintaining a constant air inflow (i.e., a maximum flow of emulsion), so that an additional related regulating process can be omitted. A staff operates the switch 111 to control the process of an external gas entering the vent pipe 11 or to switch off the vent pipe 11. The flow limiting device 112 is utilized to control and set the amount of the air inflow. When the switch 111 is turned on, the vent pipe 11 transmits a large amount of air inflow and the amount of the water flow sucked into the pump 1 is relatively lessened (air is compressible), the pressure of water flow of the pump 1 is lowered accordingly. On the other hand, when the switch 111 is turned off, the pressure of the water flow of the pump 1 can be increased. That is, with the operation of the switch 111, the purpose of changing the pressure of the output water flow of the pump 1 can be attained.

Further, the flow limiting device 112 is pre-regulated and fixed at a position where enables the air flow and the pressure change of the pump 1 to have a maximum mixed effect. Therefore, when the switch 111 is turned on, the flow limiting device 112 is utilized to control a mixing ratio of the water flow and air sucked by the pump 1, and then an emulsion fountain effect is output after the water flow passes through the flow limiting device 112. When the switch 111 is turned down to reduce the air flow traveling through the vent pipe 11 or to stop the air flow of the vent pipe 11, the pressure of the pump 1 can be controllably increased to obtain different pressure water columns ejected from the jet 13, in which the pressure of the pump 1 is detected by a pressure gauge 14.

Figure 3:
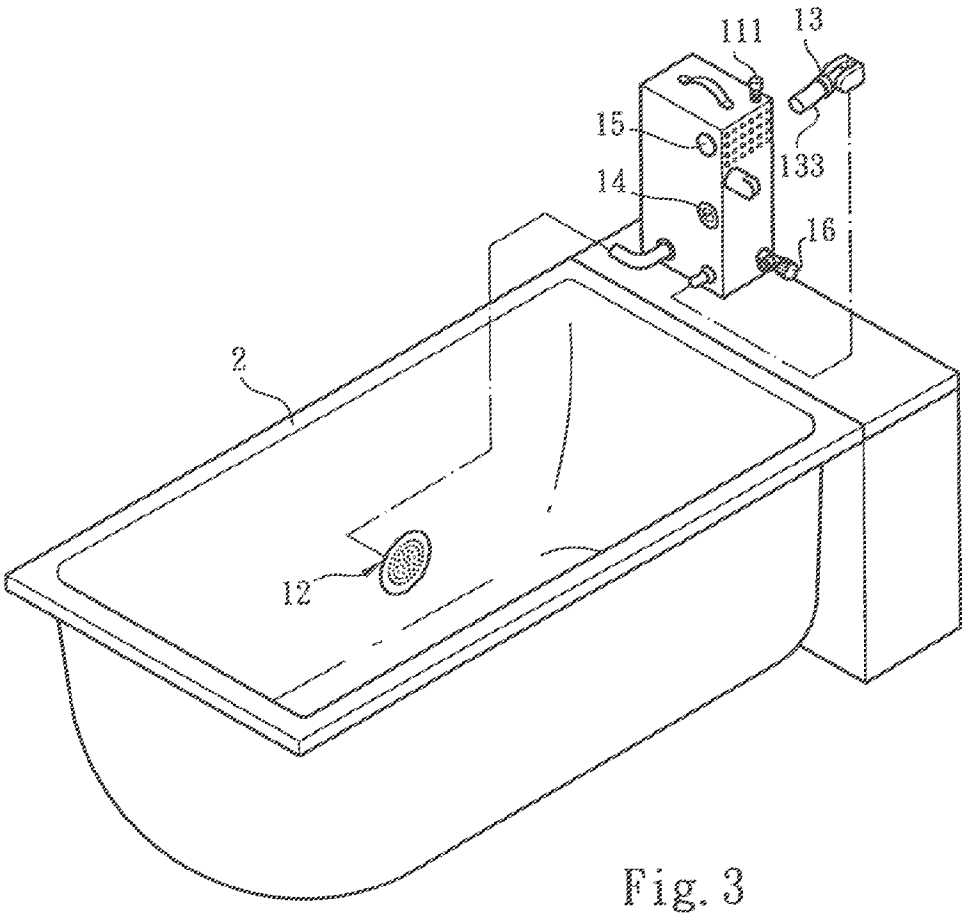
FIG. 3 is a schematic view of an embodiment of the invention.
Figure 4:
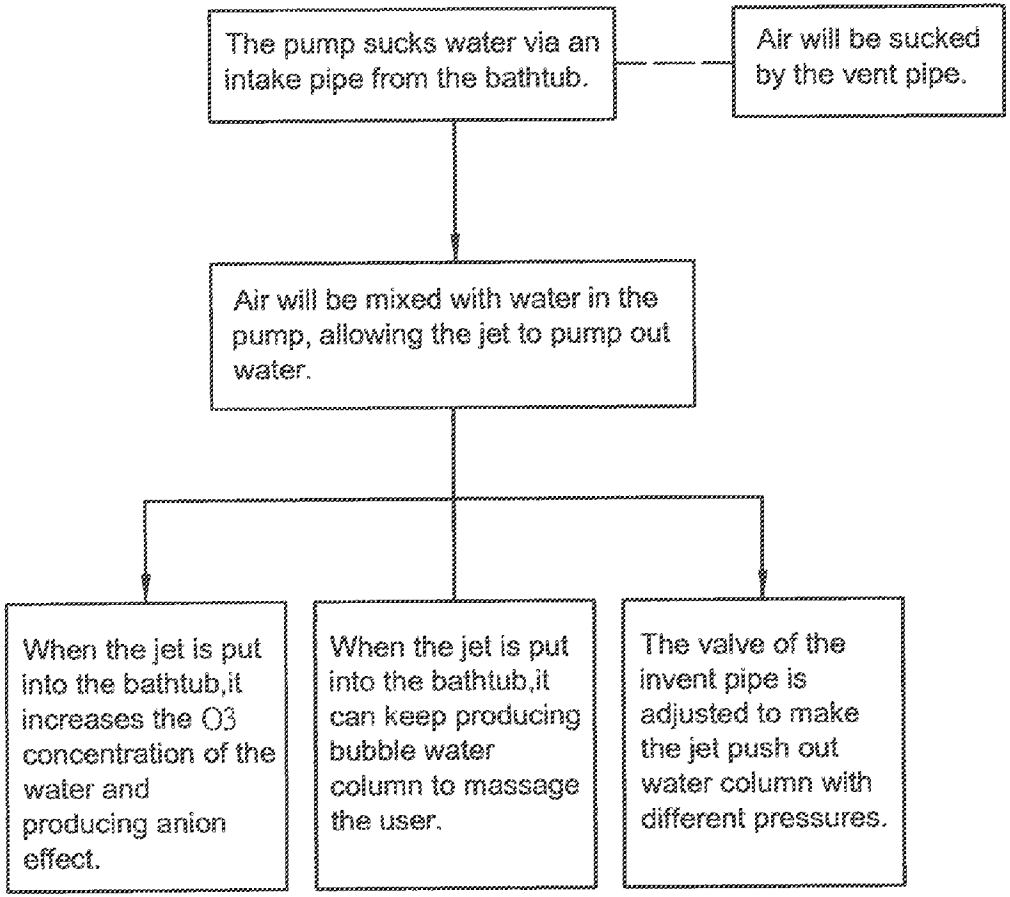
FIG. 4-4C is an operation flow chart of the invention.
Figure 4A:
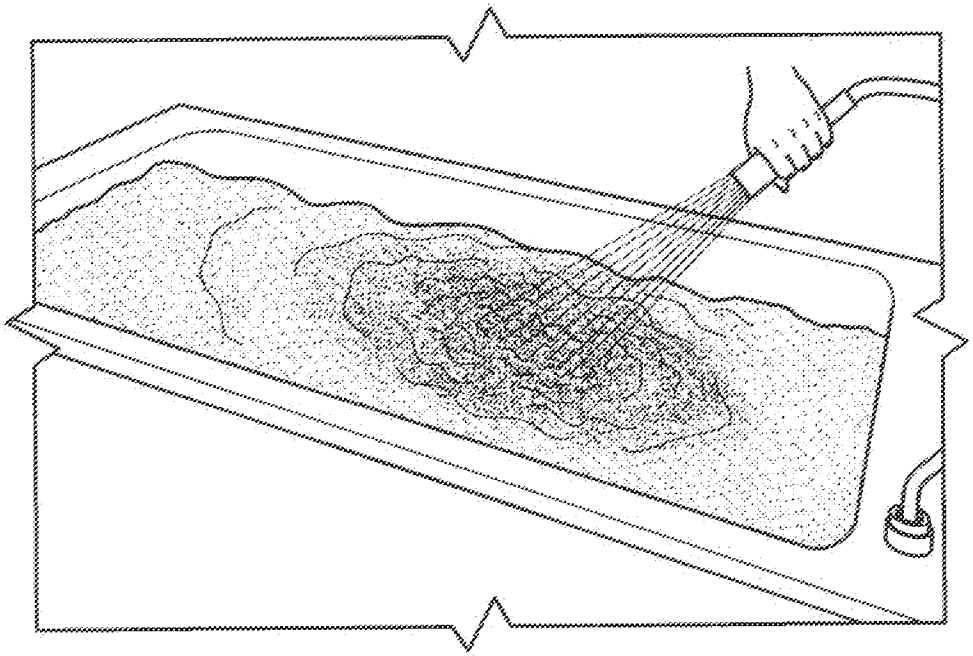
Figure 4B:
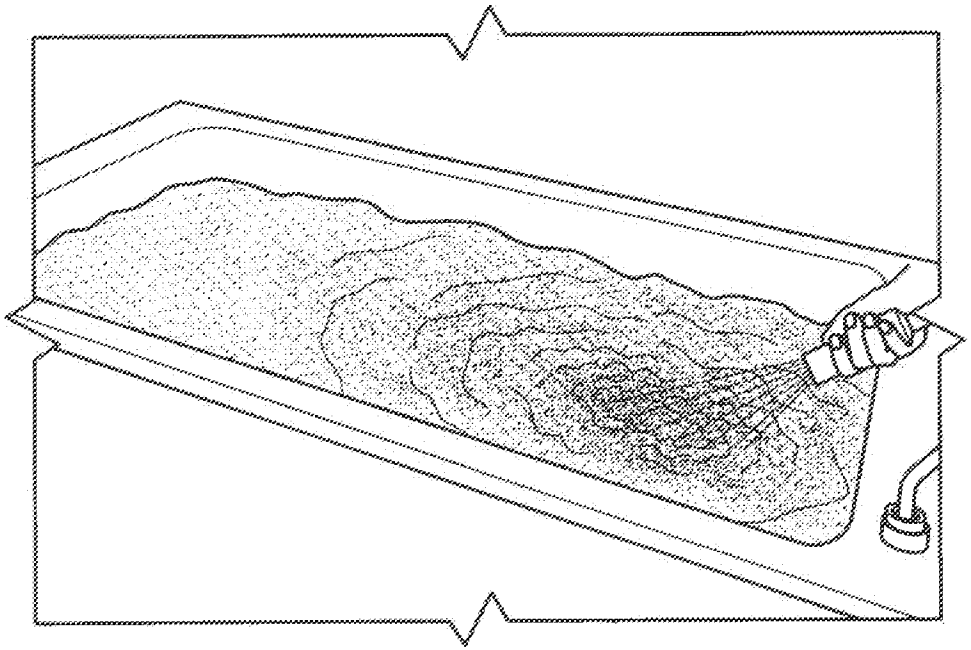
Figure 4C:
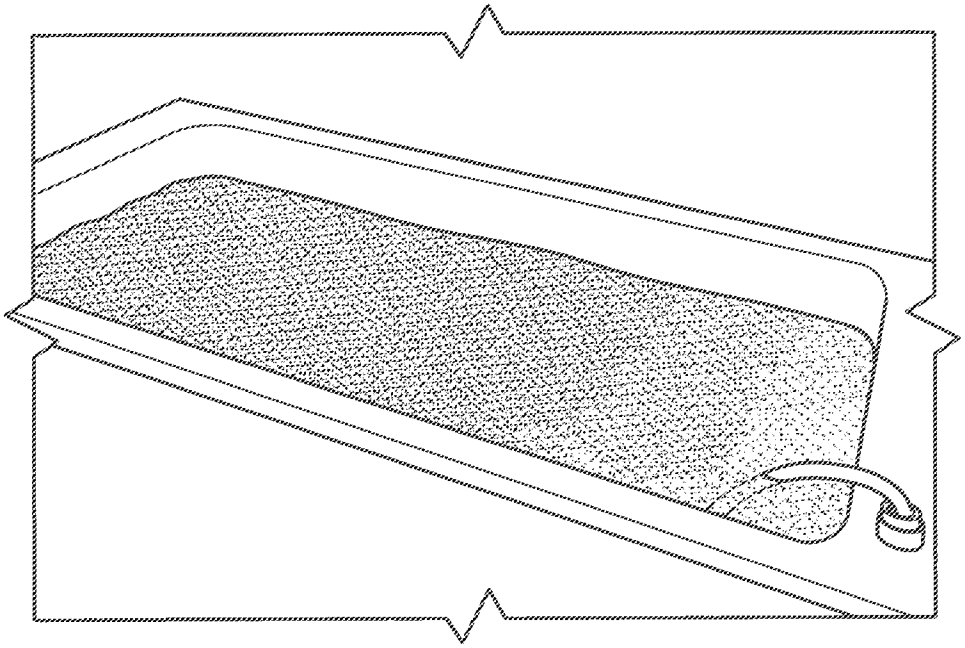

In FIG. 3, with the intake pipe 12 providing one-way valve and the normally closed type solenoid valve 17 being capable of blocking air intake of the vent pipe 11 as the pump 1 is not activated, when a user activates the main switch 15 to suck the water flow from a bathtub 2 through the intake pipe 12, the pump 1 can be prevented from forming a vacuum state therein while the water flow flows out from the pump 1. Water can be filled into the pump 1 through a water feed valve 16 when water in the pump 1 is accidentally drained off. The intake pipe 12 can be fixedly disposed in the bathtub 2 by means of stationary design. By spraying an initial ejected water flow from the jet 13 outside the bathtub 2, the waste water remained in the pump 1 and pipes thereof can be completely removed. As shown in FIGS. 4A, 4B and 4C, with the jet 13 installed in the bathtub 2, water columns with large amount of bubbles can be continuously and circulatingly output from the jet 13 to form turbulences in the bathtub 2, thereby massaging a user's body by turbulences and bubbles and achieving functions of a massage bathtub. Moreover, with the operation of the switch 111, water in the bathtub 2 can be processed to instantaneously produce numerous micro bubbles, thereby forming a creamy-white water possessing a highly oxygen concentration to generate anion function. As shown in FIGS. 4, 4A, 4B and 4C, the jet 13 can be removed for outputting water to scour on user's body with different pressures, thus to attain a multifunctional spa performance.

Figure 5:
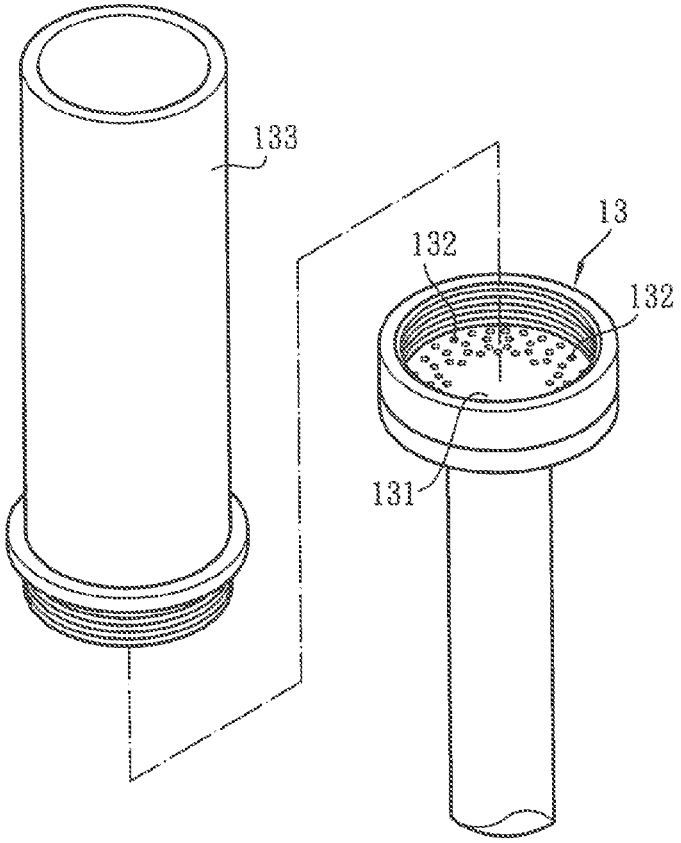
FIG. 5 is a structural diagram of a jet of the invention.

As shown in FIG. 5, a thin-plate type outlet disk 131 is configured in the jet 13, and the pores 132 are distributed on an outer circumference region of the outlet disk 131, so that a fine and delicate water flow can be outwardly ejected through the pores 132.

Further, a pipe 133 is connectively configured on an exterior of the outlet of the jet 13. When the water flows or the water columns are ejected by the jet 13 through the pipe 133, the water columns ejected from the outlet disk 131 are impacted on the pipe wall of the pipe 133 and then ejected outwardly due to all pores 132 being distributed on the outer circumference region of the outlet disk 131. Moreover, the retention water located on a nearby region (i.e., a region without pore) of the pores 132 is reciprocally oscillated therearound due to vacuum effect therein, thereby forming an enhanced turbulent action (shown in FIGS. 6 and 6A) to generate more fine and delicate bubbles. When the user holds the jet 13 for use, the water flow ejected through the pipe 133 can be collectively bundled into a water column (shown in FIGS. 7 and 7A) by a manual operation process.

Specifically speaking, in the entire structural design of the invention, the jet 13 can be utilized to output an emulsion foam or the water flows or the water columns with different pressures to functionally scour user's body. That is, with the pores 132 deployed on the outer circumference region of the outlet disk (131, a local (peripheral and central) non-pore region behind the pores 132 is formed into a vacuum region X when a high pressure water flow passes through the pores 132 to eject the water columns, so that the retention water located on the nearby region of the pores 132 is reciprocally oscillated therearoud.

Figure 6:
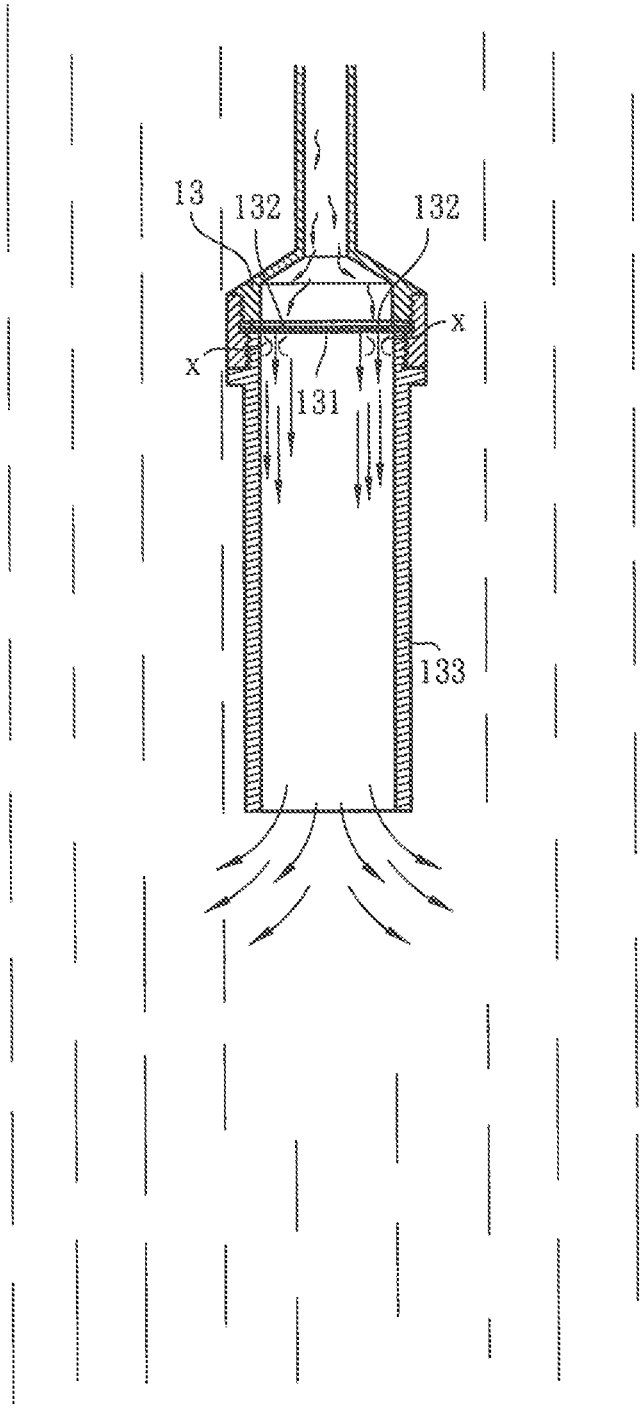
FIG. 6-6A is an exemplified view of a jet of the invention to be disposed in a bathtub, illustrating a condition of a turbulent action which is generated by a vacuum region formed at a circumference of pores.
Figure 6A:
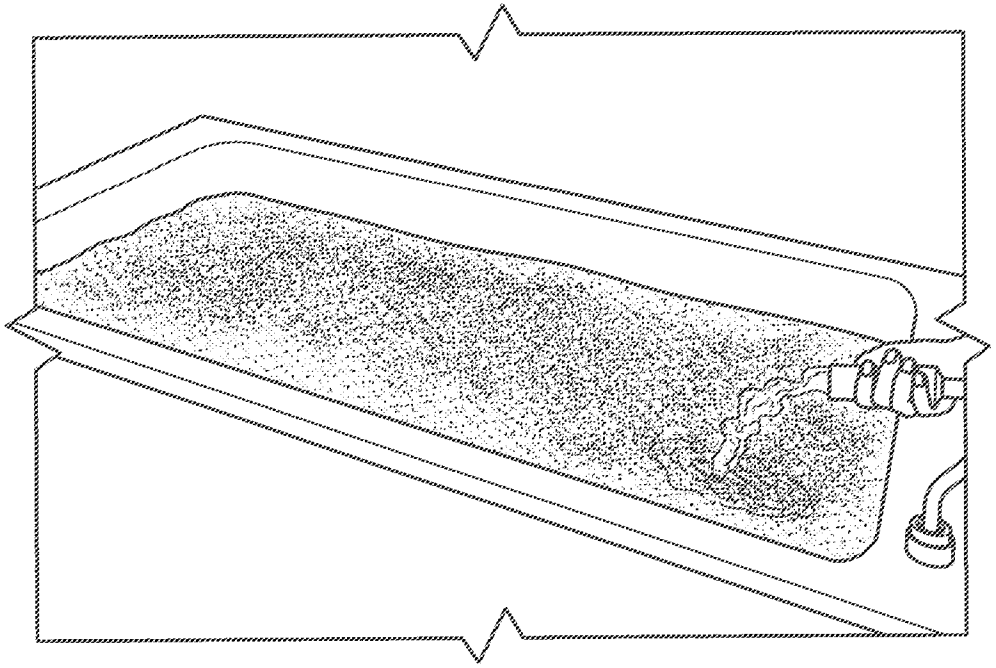
Figure 7:
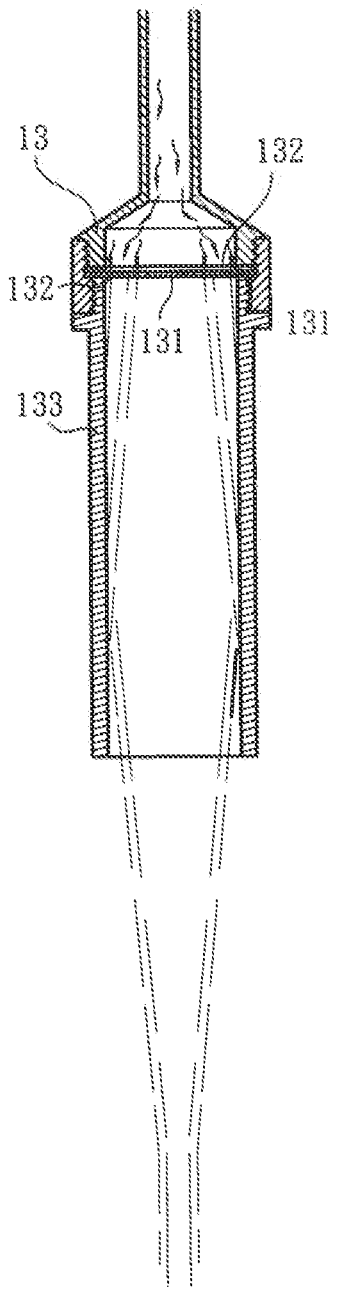
FIG. 7-7A is an exemplified state diagram of a held jet of the invention.
Figure 7A:
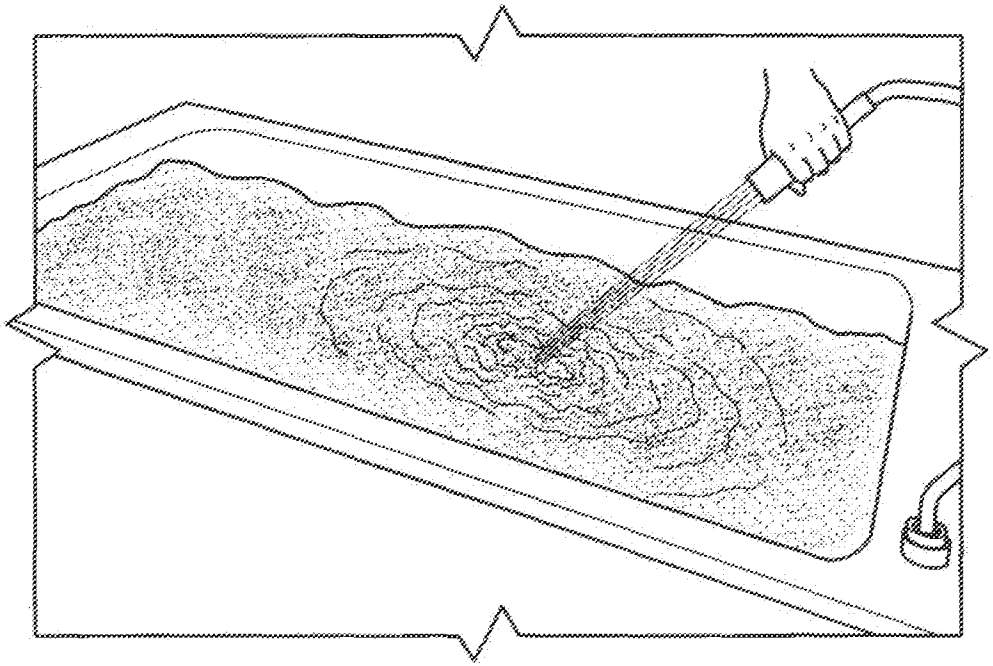

Referring to FIGS. 4A, 4B, 4C and 6, when the jet 13 (together with the pipe 133) is put in water of the bathtub 2 or in water, the water flows or the water columns containing lots of bubbles output from the pores 132, besides the turbulent action generated by vacuum region X formed at the circumference of the pores 132, are still more swashed with the water of the bathtub 2 reciprocally, so that more large number of micro bubbles or local emulsion foams (or referred as emulsion fountains) are generated. In FIG. 6, when the user removes the assembly of the jet 13 and the pipe 133 from the bathtub 2, the retention water within the vacuum region X is centrifugally threw away the pipe 133 when the assembly of the jet 13 and the pipe 133 is forcedly swung by the user. Accordingly, the water flows ejected from the pores 132, capable of not being suffered from oscillation and disturbance in the pipe 133, are aggregately formed into a high-strength ejected water column (e.g., the condition shown in FIGS. 7 and 7A) for use of swashing massage.

It is needed to explain that, after pushing or ejecting the water flow (i.e., after outputting the gas-liquid mixture), if the gas-liquid mixed position is not further acted by any high pressure pushing and releasing processes and measures, the degree of bubble split in water is to be limited, incapable of forming ultramicro bubble water (i.e., water with emulsion effect). However, in the disclosed stage of the invention, it is included that a gas-liquid mixture or a gas-bearing water is pressurized by the pump 1, air sucked by the pump 1 is compressed to mix with water (i.e., air is forced to dissolve in water), and the water mixed with air is squeezingly passed through the pores 132 of the outlet disk 131. In the process of the gas-liquid mixture which is highly pressurized and released to pass through the pores 132 of the outlet disk 131, the high pressure gas dissolved in water is pressurizingly released, expanded and evaporated, so that the gas in water is split into ultramicro bubbles to be suspended in water. Accordingly, the cleanness of human body can be attained when the ultramicro bubbles are swelling enlarged and ruptured with the pressure releasing therefrom.

What is claimed is:

1. A multifunctional spa device, comprising:

a pump disposed with a water tub to generate a pressurized water-air mixture for water contained in the water tub;

a vent pipe coupled to an inlet of the pump controlled by a circuit;

an intake pipe extending from the pump into the water contained in the water tub for guiding the water into the pump; and, a jet assembly coupled to an outlet of the pump by an intermediate pipe portion, the jet assembly generating a turbulent action upon the pressurized water-air mixture expelled from the pump drawing water flow and air therein through the intake pipe and vent pipe;

a flow limiting valve mechanism connected inline to the vent pipe for controlling air flow into the pump prior to mixing of the water-air mixture output from the pump, thereby controlling the pressure of the water flow output from the pump;

wherein the jet assembly includes an outlet disk portion extending diametrically outward beyond the intermediate pipe portion to form therefor a diametrically expanded termination, the outlet disk portion having a plurality of pores collectively arranged peripherally about the intermediate pipe portion for diametrically dispersed passage of the pressurized water-air mixture received therefrom;

a vacuum being formed thereby at a local region behind the pores when a high pressure water flow passes through the pores to eject a water column of microbubbles.

2. The multifunctional spa device as claimed in claim 1, wherein the vent pipe is configured with a switch.

3. The multifunctional spa device as claimed in claim 1, wherein a pipe extension is coaxially coupled to extend from the outlet disk portion of the jet assembly, the pipe extension being substantially matched in diameter to the outlet disk portion.

4. The multifunctional spa device as claimed in claim 1, wherein a normally closed type solenoid valve disposed between the vent pipe and the pump is connected to a main switch.

5. The multifunctional spa device as claimed in claim 1, wherein the outlet disk portion includes a circular thin-plate type outlet disk is configured in the jet, and the pores are distributed on an outer circumference region of the outlet disk.

* * * * *